United States Patent [19]

Pringle et al.

[11] Patent Number: 4,718,488

[45] Date of Patent: Jan. 12, 1988

[54] PUMP-OUT PLUG SYSTEM FOR A WELL CONDUIT

[75] Inventors: Ronald E. Pringle, Houston; Arthur J. Morris, Magnolia, both of Tex.

[73] Assignee: Camco, Incorporated, Houston, Tex.

[21] Appl. No.: 24,950

[22] Filed: Mar. 12, 1987

[51] Int. Cl.[4] ..... E21B 33/12

[52] U.S. Cl. ..... 166/135; 166/192; 166/317; 166/332

[58] Field of Search ..... 166/115, 125, 135, 181, 166/188, 192, 316, 317, 387, 386, 116, 117, 332, 291

[56] References Cited

U.S. PATENT DOCUMENTS

| | | | |
|---|---|---|---|
| 2,651,368 | 9/1953 | Baker et al. | 166/188 |
| 2,928,469 | 3/1960 | Crowe | 166/135 |
| 3,180,420 | 4/1965 | Manson, Jr. et al. | 166/332 |
| 3,946,807 | 3/1976 | Amancharla et al. | 166/135 |
| 3,954,138 | 5/1976 | Miffre | 166/317 |
| 4,007,783 | 2/1977 | Amancharla et al. | 166/135 |
| 4,109,716 | 8/1978 | Canalizo | 166/192 |
| 4,188,999 | 2/1980 | Amancharla et al. | 166/135 |
| 4,405,017 | 9/1983 | Allen et al. | 166/135 |
| 4,448,427 | 5/1984 | Mashaw, Jr. | 166/332 |
| 4,576,236 | 3/1986 | Stout et al. | 166/192 |

*Primary Examiner*—Stephen J. Novosad
*Assistant Examiner*—Bruce M. Kisliuk
*Attorney, Agent, or Firm*—Fulbright & Jaworski

[57] ABSTRACT

A landing nipple having a landing sub is adapted to be connected to a production well conduit. When temporarily abandoning the well, a pump-out plug is seated in the landing sub and includes a bi-directional valve which allows flow through the plug when running and after seating seals in both directions. When desired, the pump-out plug and landing sub may be expelled by pressure to provide a full bore production of the well.

10 Claims, 6 Drawing Figures

20
22
10
12
18
46
23
18
12
32
72
70
34
38
16
12
38
34
42
44
30
18
24
64
36
40
28
62
14
66
56
26
52
74
26
50
60
16
58
54
30a
14a
28a
26a
24
12

42
70
34
10
38
16
34
44
36
56
64
60
74
58
16

PUMP-OUT PLUG SYSTEM FOR A WELL CONDUIT

BACKGROUND OF THE INVENTION

For various reasons, oil and/or gas wells are temporarily plugged and left, and at a later time are brought back into production. Safety and environmental regulations require that temporarily leaving a completed live well requires costly installations. When it is desired to reopen the wells, various types of tubing plugs must be either retrieved or opened by wireline or other methods such as ball drop while applying pressure to the tubing. Existing equipment available today are landed in tubing nipples on conventional locks but have the disadvantage of leaving the production bore restricted.

The present invention is directed to a pump-out plug system for a well conduit in which a landing nipple and sub are connected to the lower portion of the well tubing or conduit. When it is desired to plug the well, a pump-out plug is landed in the landing nipple. The pump-out plug has a bi-directional valve which is opened when running the plug for allowing fluid bypass and after landing closed to provide a positive seal in both directions. When it is desired to bring the well back into production, pressure from the surface pumps out the plug and allows full bore production of the well to be reinitiated. By using a modular design, this process may be repeated as required.

SUMMARY

The present invention is directed to a pump-out plug system for a well conduit which includes a landing nipple adapted to be connected to a well conduit in which the nipple includes a no-go shoulder and a recess extending out of the bottom of the nipple. A landing sub is telescopically positioned in the recess and includes a locking notch. Shear means releasably locks the landing sub to the landing nipple and seal means is provided between the landing sub and the landing nipple.

A pump-out plug is adapted to seat in the landing sub and includes expandable locking means for engaging the locking notch for locking the plug in the landing sub. A seal means is provided between the plug and the landing sub. A bi-directional flow blocking valve is connected to the plug which when opened allows fluid flow through the plug for allowing the plug to be run into the well conduit and when closed prevents fluid flow through the plug. A running tool is releasably connected to the plug for landing the plug in the landing sub and is releasably connected to the valve for holding the valve in the open position when running the plug into the landing sub.

Still a further object of the present invention is wherein the bi-directional valve includes first and second valve elements and valve seats and spring means are provided yieldably urging the first and second valve elements and seats towards the closed position.

Still a further object of the present invention is the provision of a tensile separation member connected between a running tool and the bi-directional valve initially holding the first and second valve elements and valve seats in the open position.

Still a further object of the present invention is the provision of at least one additional landing sub positioned in the recess of the landing nipple below the first landing sub in which the additional landing sub includes a locking notch for receiving a pump-out plug. Seal means is provided between the additional landing sub and the nipple and shear means releasably locks the additional landing sub to the landing nipple. This structure provides a modular design allowing the well to be plugged and reopened more than once.

Still a further object of the present invention is the provision of a landing sub and landing nipple for a well conduit for receiving a pump-out plug which includes a landing nipple adapted to be connected to the lower end of a well conduit and which includes a no go shoulder and a recess extending out of the bottom of the nipple. One or more landing subs are telescopically movable in the recess and each sub includes a locking notch for receiving a pump-out plug, seal means between each landing sub and the landing nipple and shear means releasably locking each of the landing subs to the landing nipple for holding a pump-out plug in the landing nipple but which are movable out of the landing nipple when the plug is pumped out of the nipple.

Yet a still further object of the present invention is the provision of a pump-out plug for installation in a landing sub in a well conduit in which the landing sub includes a locking notch. The plug includes a body having a bore therethrough. Seal means are provided on the body for sealing with the landing sub and expandable locking means are provided on the body for engaging the locking notch for locking the body in the landing sub. A bi-directional flow blocking valve is positioned in the bore. The valve is openable for allowing fluid flow through the valve when the body is being run into the well conduit and the valve is closeable when seated in the landing sub for preventing fluid flow in either direction through the bore.

A still further object of the present invention is wherein the bi-directional valve includes first and second valve seats on the body coacting with first and second valve elements, respectively, and spring means are provided between the valve elements yieldably urging the valve elements onto the seats. Seal means are provided between the valve elements.

Yet a still further object of the present invention is the provision of a second locking means on the body for holding the expandable locking means in the locked position.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

Figures 1A, 1B, 1C, 1D:
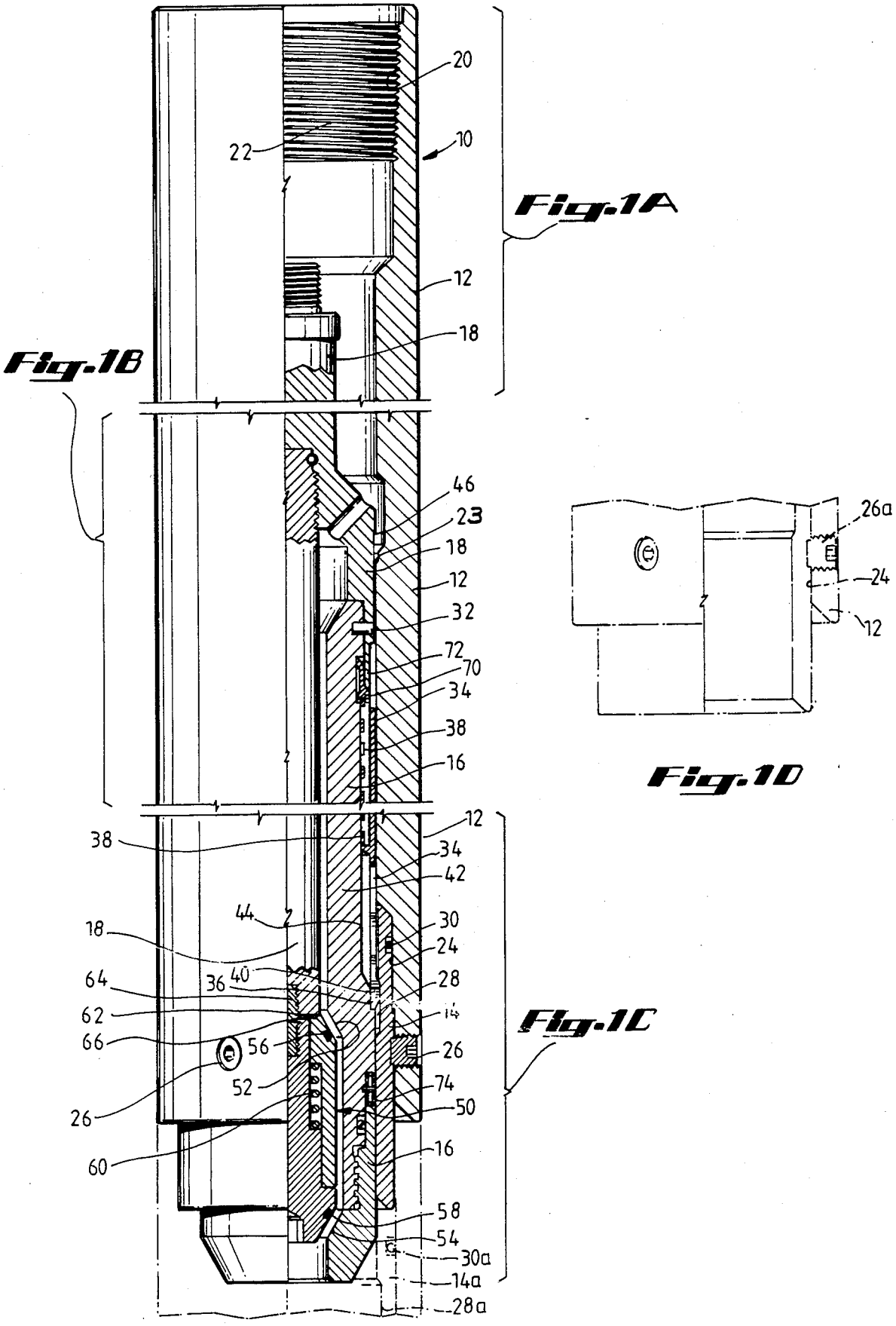
FIGS. 1A, 1B, 1C, and 1D are continuations of each other and are elevational views, in quarter section, showing a running in tool installing a pump-out plug in a landing sub in a landing nipple.

Referring now to the drawings, and particularly to FIGS. 1A–1D, the pump-out plug system of the present invention is generally indicated by the reference numeral 10 and generally includes a landing nipple 12, a landing sub 14 (FIG. 1C), a pump-out plug 16 (FIGS. 1B and 1C), and a running tool 18.

The landing nipple 12 includes connecting means at the top such as threads 20 for connection to the lower end of an oil and/or gas well production tubing, includes a bore 22 therethrough which is substantial of the same cross-sectional area as the bore of the connected well tubing, and when opened allows well production flow therethrough, a no-go shoulder 23 (FIG. 1B) for setting the pump-out plug 16 in the landing nipple 12, and a recess 24 (FIGS. 1C and 1D) extending out of the bottom for telescopically receiving the landing sub 14 but allowing the landing sub 14 to be pumped out of the bottom of the landing nipple 12 as will be more fully described hereinafter.

The landing sub 14 is telescopically positioned in the recess 24 of the nipple 12 and is initially secured therein by shear means such as shear pin 26. The landing sub 14 includes a locking notch 28 for receiving the pump-out plug 16 and seal means 30 are provided between the landing sub 14 and the landing nipple 12.

The pump-out plug 16 is run into the well production tubing or conduit and into the landing nipple 12 by being connected to the running tool 18 by a releasable connection such as shear pin 32 (FIG. 1B). Expandable locking means are connected to the plug 16 for engaging the locking notch 28 of the landing sub 14. The locking means may be a collet 34 having locking dogs 36 (FIG. 1C) which are normally biased by a spring 38 downwardly onto a locking shoulder 40 on the body 42 of the plug 16. When the locking dogs enter the landing nipple 12 and contact the no-go shoulder 23 they are pushed upwardly into a recess 44 on the body 42 into a collapsed position allowing the plug 16 to continue to move downwardly through the landing nipple 12 and landing sub 14 until a shoulder 46 on the running tool engages the no-go shoulder 23. At this position, the dogs 36 are in alignment with the locking notch 28 in the landing sub 14 and are moved downwardly onto the shoulder 40 by the action of the spring 38. At this point, the plug 16 is locked into the landing sub 14, as best seen in FIG. 1C.

A bi-directional flow blocking valve, generally indicated by the reference numeral 50, is connected to the pump-out plug 16 which is opened during the running in procedure to allow fluid flow through the plug 16 but which is closed after being set to prevent fluid flow through the plug 16 in either direction. The bi-directional valve includes first and second valve elements and valve seats, and spring means yieldably urging the first and second valve elements and seats towards the closed position. For example, valve seats 52 and 54 are provided on the body 42 and valve elements 56 and 58 are positioned to seat on the seats 52 and 54, respectively. Spring means 60 are provided between the valve elements 56 and 58 for urging the valve elements 56 and 58 into a seated and closed position.

As best seen in FIG. 1C, in the running position, the running tool 18 holds the valve 50 in the open position by a shoulder 62 engaging one of the valve elements 56 and is connected to the second valve element 58 by a tensile separation member 64. The member 64 is threadably connected to both the running tool 18 and the valve element 58 and includes a weakened portion 66. After the plug 16 is locked in the locking notch 28 by the locking dogs 36, an upward jar is taken on the running tool 18 which shears the pin 32 and the member 64 at location 66 thereby releasing the running tool 18 from the pump-out plug 16.

Figures 2A, 2B:
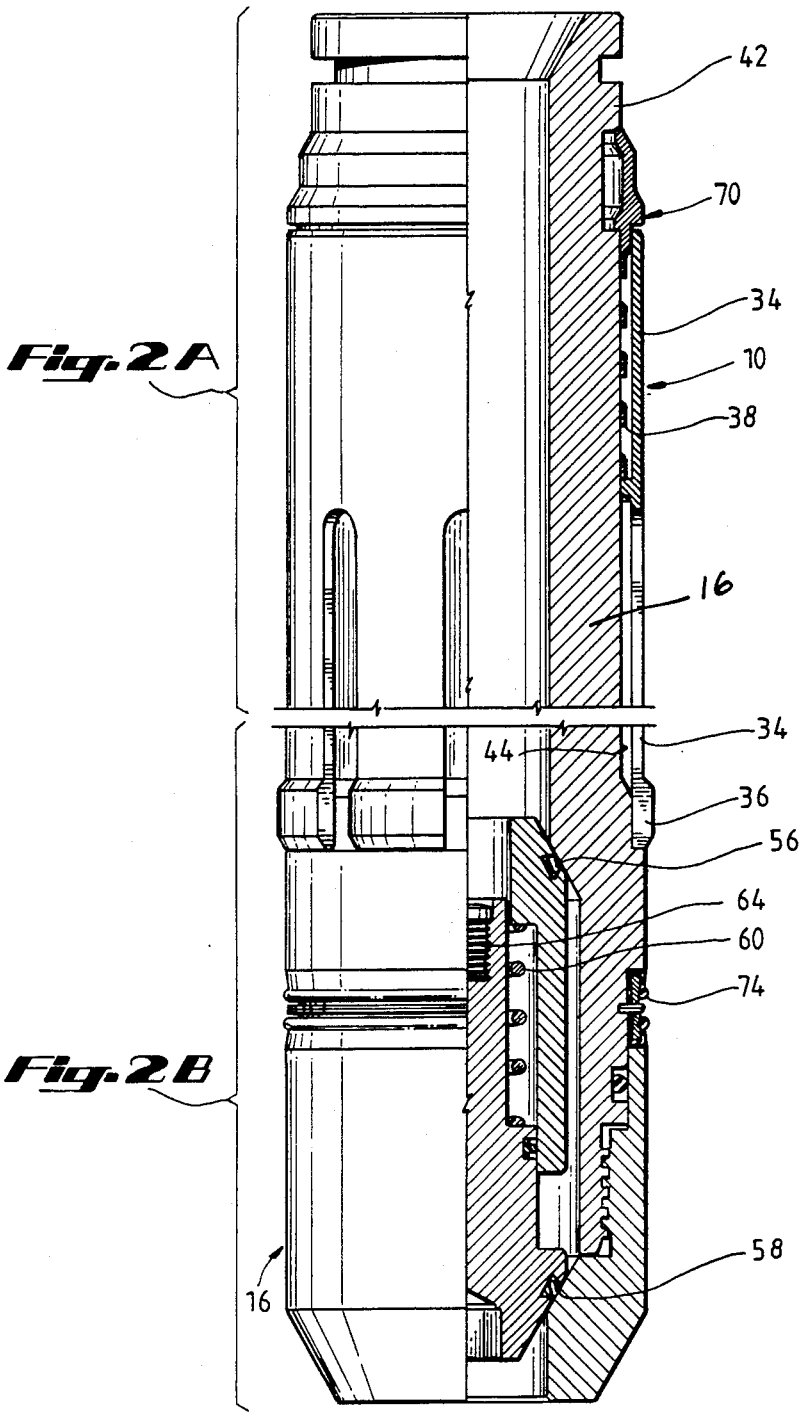
FIGS. 2A and 2B are continuations of each other and are elevational views, in cross section, of the pump-out plug of the present invention shown in the installed and closed position.

After release of the running tool 18, the pump-out plug 16 is in the position shown in FIGS. 2A and 2B with the bi-directional valve 50 closed in both directions thereby preventing fluid flow in either direction.

Referring now to FIGS. 1B and 2A, a second locking means such as a expandable locking snap ring 70 is positioned on the body 42 of the pump-out plug 16 and is initially held in the contracted position in FIG. 1B by a sleeve 72 on the running tool 18 so as not to interfere with the movement of the collet 34. However, after the running tool 18 has been disconnected from the pump-out plug 16, the locking snap ring 70 expands behind the collet 34 as best seen in FIG. 2A, to securely lock the locking dogs 36 in the locking notch 28. Seal means 74 are provided between the plug 16 and the landing sub 14.

In operation, the landing nipple 12 and landing sub 14 are connected to the lower end of a well production tubing and provides a full open bore for production of well fluids therethrough. In the event that the well must be temporarily abandoned, the pump-out plug 16 is connected to a running tool 18 by shear pins 32 and member 64 which holds the second locking means 70 in the retracted position and holds the bi-directional valve 50 in the open position. The running tool 18 and plug 16 is run into the well tubing such as on conventional wireline or pumpdown operations. When the locking dogs 36 engage the no-go shoulder 23 on the landing nipple 12, the collet 34 is moved upwardly over the snap ring 70 and the dogs 36 retract into the recess 34 allowing the plug 16 to move downwardly into the landing sub 14. When the shoulder 46 on the running tool 18 engages the no-go shoulder 24, the dogs 36 are moved downwardly and into the locking notch 28 by the spring 38 and onto the locking shoulder 40 thereby seating the pump-out plug 16 in the landing sub 14. The running tool 18 is removed by shearing the pins 32 and member 64 allowing the bi-directional valve 50 to seat in both directions and allowing the snap ring 70 to lock the collet 34 and dogs 36 in place. The well is now in a shut-off position with flow through the wellbore blocked from pressure either in an upwardly or a downwardly direction.

When it is desired to reactivate the well, pressure is applied from the well surface through the well conduit and landing nipple 12 to provide a predetermined force acting on the pump-out plug 16 to shear the shear pins 26. The pump-out plug 16 and landing nipple 12 are then pumped out of the bottom of the landing nipple 12 and into the bottom of the well hole and well production can be resumed. It is to be noted that the landing nipple 12 is unrestricted to fluid flow and provides a full open bore after expulsion of the pump-out plug 16.

With only a single landing sub 14, this process can only be performed one time. Therefore, if desired, one or more additional landing subs **14*a* may be secured in the recess 24 of the landing nipple 12, as best seen in FIGS. 1C and 1D. Each landing sub 14*a* includes shear means 26*a*, seal 30*a* and a locking notch 28*a*. With such an arrangement, the pump-out plug 16 may be seated the first time in the lowermost landing sub 14*a*, by a running tool of the proper length. When the well is reactivated, the pump-out plug 16 and the lowermost landing sub 14*a* is pumped out. If it is again desirable to shut in the well another pump-out plug 16 may be set in the next upper landing sub 14** and the process repeated.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. A pump-out plug system for a well conduit comprising, a landing nipple adapted to be connected to a well conduit, said nipple including a no-go shoulder and a recess extending out the bottom of the nipple, a landing sub is telescopically positioned in the recess, said sub including a locking notch, seal means between the landing sub and the landing nipple, shear means releasably locking the landing sub to the landing nipple, a pump-out plug adapted to seat in the landing sub, expandable locking means connected to the plug for engaging the locking notch for locking the plug in the landing sub, a bi-directional flow blocking valve connected to the plug which when opened allows fluid to flow through the plug and when closed prevents fluid flow through the plug, and a running tool releasably connected to the plug for landing the plug in the landing sub and releasably connected to the valve for holding the valve in the open position when running the plug into the landing sub.

2. The apparatus of claim 1 wherein the bi-directional valve includes, first and second valve elements and valve seats, spring means yieldably urging said first and second valve elements and seats toward the closed position.

3. The apparatus of claim 2 including, a tensile separation member connected between the running tool and the bi-directional valve initially holding the first and second valve elements and valve seats in the open position.

4. The apparatus of claim 1 including, at least one additional landing sub positioned in the recess of the landing nipple below the landing sub, said additional landing sub including an additional locking notch for receiving a pump-out plug, additional seal means between the additional landing sub and the nipple, and additional shear means releasably locking the additional landing sub to the landing nipple.

5. A landing sub and landing nipple for a well conduit for receiving a pump-out plug comprising, a landing nipple adapted to be connected to a well conduit, said nipple including a no-go shoulder and a recess extending out the bottom of the nipple, a landing sub telescopically movable in the recess, said sub including a locking notch for receiving and holding a pump-out plug from upward or downward movement in the landing sub, seal means between the landing sub and the landing nipple, shear means releasably locking the landing sub to the landing nipple for holding a pump-out plug in the landing nipple but movable out of the landing nipple when the plug is pumped out of the nipple.

6. The apparatus of claim 5 including, at least one additional landing sub positioned in the recess of the landing nipple below the landing sub, said additional landing sub including an additional locking notch for receiving a pump-out plug, additional seal means between the additional landing sub and the nipple, and additional shear means releasably locking the additional landing sub to the landing nipple.

7. A pump-out plug for installation in a landing sub in a well conduit in which the landing sub includes a locking notch comprising, a body, said body having a bore therethrough, seal means on the body for sealing with the landing sub, expandable locking means on the body for engaging the locking notch for locking the body in the landing sub, a bi-directional flow blocking valve positioned in the bore, said valve being openable for allowing fluid flow through the valve when the body is being run into the well conduit, and said valve being closeable when seated in the landing sub for preventing fluid flow in either direction through the bore.

8. The apparatus of claim 7 wherein the valve includes, first and second valve elements and valve seats, spring means yieldably urging said first and second valve elements and seats toward the closed position.

9. The apparatus of claim 7 wherein the valve includes, first and second valve seats on the body coacting with first and second valve elements, respectively, spring means between the valve elements yieldably urging the valve elements onto the seats, seal means between the valve elements.

10. The apparatus of claim 7 including, a second locking means on the body for locking the expandable locking means in the locked position.

* * * * *